US011181048B2

(12) United States Patent
Hamasaki

(10) Patent No.: US 11,181,048 B2
(45) Date of Patent: Nov. 23, 2021

(54) THROTTLE DEVICE

(71) Applicant: MIKUNI CORPORATION, Tokyo (JP)

(72) Inventor: Daisuke Hamasaki, Odawara (JP)

(73) Assignee: MIKUNI CORPORATION, Tokyo (JP)

( * ) Notice: Subject to any disclaimer, the term of this patent is extended or adjusted under 35 U.S.C. 154(b) by 67 days.

(21) Appl. No.: 16/250,671

(22) Filed: Jan. 17, 2019

(65) Prior Publication Data

US 2019/0226408 A1 Jul. 25, 2019

(30) Foreign Application Priority Data

Jan. 23, 2018 (JP) ..... JP2018-008805

(51) Int. Cl.
*F02D 9/10* (2006.01)
*F02M 35/16* (2006.01)
*F02B 61/02* (2006.01)

(52) U.S. Cl.
CPC ..... *F02D 9/105* (2013.01); *F02D 9/1065* (2013.01); *F02D 9/1095* (2013.01); *F02M 35/162* (2013.01); *F02B 61/02* (2013.01)

(58) Field of Classification Search
CPC ..... F02D 9/105; F02D 11/106; F02D 9/1065; F02D 9/1095
See application file for complete search history.

(56) References Cited

U.S. PATENT DOCUMENTS 5,672,818 A * 9/1997 Schaefer ..... F02D 11/106 73/114.36
6,288,534 B1 * 9/2001 Starkweather ..... F02D 11/10 123/617

(Continued)

FOREIGN PATENT DOCUMENTS

DE 19540586 A1 * 5/1997 ..... F16B 2/24
EP 0 867 608 A2 9/1998

(Continued)

OTHER PUBLICATIONS

Extended European Search Report dated Jun. 21, 2019 in corresponding European Patent Application No. 19152225.9 (8 pages).

(Continued)

*Primary Examiner* — Michael A Kessler

(57) ABSTRACT

A throttle device, comprising: a throttle valve (13) disposed in a plurality of intake passages (12) of a throttle body (11); a throttle shaft (14) supporting the throttle valve (13); a motor (15) for driving the throttle valve (13) to open and close through the throttle shaft (14); a rotation transmission mechanism (20) interposed between the motor (15) and the throttle shaft (14); and a position sensor to detect a displacement in the rotation transmission mechanism (20). The rotation transmission mechanism (20) includes a pinion (21) driven by the motor (15) and a control gear (23) interlocked with the pinion (21) and integrally connected to the throttle shaft (14). The position sensor (30) to detect an angular displacement of the control gear (23) and the rotation transmission mechanism (20) are disposed between the plurality of intake passages 12.

4 Claims, 6 Drawing Sheets

(56) References Cited

U.S. PATENT DOCUMENTS

| | | | | |
|---|---|---|---|---|
| 7,066,142 | B2 * | 6/2006 | Hanasato | F02D 9/1095 123/336 |
| 7,069,902 | B2 * | 7/2006 | Arai | B29C 45/14754 123/337 |
| 8,635,986 | B2 | 1/2014 | Ikeda et al. | |
| 2006/0042589 | A1 * | 3/2006 | Hanasato | F02D 11/10 123/336 |
| 2011/0290213 | A1 | 12/2011 | Ishikawa et al. | |
| 2019/0277203 | A1 * | 9/2019 | Hamasaki | F02D 9/1065 |

FOREIGN PATENT DOCUMENTS

| | | | | |
|---|---|---|---|---|
| EP | 0 867 608 | A3 | 7/1999 | |
| EP | 1 143 129 | A2 | 10/2001 | |
| EP | 2 143 914 | A1 | 1/2010 | |
| EP | 2 599 983 | A2 | 6/2013 | |
| EP | 2 740 917 | A1 | 6/2014 | |
| EP | 3514369 | A1 * | 7/2019 | F02D 9/105 |
| JP | 2010-19137 | | 1/2010 | |
| JP | 5901255 | | 3/2016 | |
| WO | WO-2004025103 | A1 * | 3/2004 | F02D 11/10 |

OTHER PUBLICATIONS

Office Action, dated Sep. 7, 2021, in corresponding Japanese Patent Application No. 2018-008805 (4 pp.).

* cited by examiner

<Prior Art>

THROTTLE DEVICE

CROSS REFERENCE TO RELATED APPLICATIONS

This application is based on and claims priority under 35 U.S.C. 119 to Japanese Patent Application No. 2018-008805, filed Jan. 23, 2018 in the Japanese Intellectual Property Office, the disclosure of which is herein incorporated by reference in its entirety.

FIELD OF THE INVENTION

The present invention relates to a throttle device, and more specifically to a multiple throttle device that controls the opening degree by a common actuator for a plurality of throttle valves on an intake passage of an engine.

BACKGROUND ART

In an electronic throttle device of a multi-cylinder internal combustion engine, specifically a throttle device of an engine mounted on a two-wheeled vehicle, by-wire type multiple-line devices, in which a plurality of throttle valves disposed in a plurality of intake passages in the vicinity of an intake port are driven and synchronized by a common electric actuator, are frequently used.

As a throttle device of this type, for example, a throttle device in which a throttle shaft supporting a throttle valve is driven by a motor with a speed reduction mechanism, while a rotation (an angular displacement) of a throttle shaft is transmitted to a sensor shaft arranged in parallel therewith by a gear, so that the angular displacement thereof is detected by a throttle position sensor as an opening degree of a throttle valve (See, for example, the Patent Document 1).

In this device, the gear for rotation transmission from the throttle shaft to the sensor shaft and the motor with the sensor shaft, the throttle position sensor, and the speed reduction mechanism are set on the center side in the direction in which the plurality of intake passages are adjacent (cylinder arrangement direction), so that the overall width of the throttle body can be prevented from being increased by the gear train for rotational transmission from the motor to the throttle shaft being positioned at the end of the throttle body.

CITATION LIST

Patent Literature

[Patent Document 1] Japanese Patent No. 5901255

SUMMARY OF THE INVENTION

Technical Problem

However, in the conventional throttle device as described above, in addition to providing a sensor shaft having a different axis from the throttle shaft in the vicinity of the center of the throttle body in the direction in which the plurality of intake ports are adjacent to each other, the gears for rotation transmission from the throttle shaft to the sensor shaft, the sensor shaft, the throttle position sensor, the motor with the speed reduction mechanism, etc. are concentratedly arranged, so that there is no choice other than to widen the interval between the two intake passages at the center in the cylinder arrangement direction.

For this reason, even though the rotation transmission mechanism (gear train) for controlling the throttle valve opening degree and the throttle position sensor are not allowed to protrude outside the entire width range of the throttle body, it is not easy to make the throttle device compact as a whole and in addition, there is a problem that the degree of freedom of arrangement of the throttle device in the vertical direction is limited with the sensor arrangement of the sensor shaft and the shaft end portion thereof.

The present invention has been made to solve the above-described conventional problems, and for the purpose of providing a throttle device in which it is unnecessary to dispose the position sensor so as to protrude outside the entire width range of the throttle body, thereby making it possible to miniaturize the throttle device and expand the degree of freedom of arrangement.

Means To Solve The Problem

To achieve the above object, a throttle device according to the present invention is a throttle device mounted on an engine having a plurality of intake ports, the throttle device comprising: a plurality of throttle bodies having intake passages formed therein; a throttle valve provided so as to control a degree of opening in the intake passages; a throttle shaft supporting the throttle valves; an actuator that drives the throttle valve to open and close through the throttle shafts; a rotation transmission mechanism interposed between the actuator and the throttle shaft; and a position sensor that detects a displacement in the rotation transmission mechanism, wherein the rotation transmission mechanism includes a first transmission member driven by the actuator and a second transmission member capable of interlocking with the first transmission member and is integrally connected to the throttle shaft in a rotation direction, and the position sensor, that detects the displacement of the second transmission member, and the rotation transmission mechanism are disposed between the plurality of throttle bodies.

In the throttle device according to the present invention, when the first transmission member is driven by the actuator, the throttle shaft rotates integrally with the second transmission member engaged with the first transmission member, so that the throttle valve opening degree changes. Then, the angular displacement of the second transmission member is detected by the position sensor, so that the opening degree of the throttle valve is detected. Therefore, it is not necessary to provide a functional portion around the intake passage such as a transmission element of a separate member other than the sensor shaft in order to cause the position sensor to detect the angular displacement of the throttle shaft, thereby making it possible to narrow the interval between the two intake passages adjacent in the cylinder arrangement direction.

In the throttle device according to the present invention, it is preferable that the plurality of throttle bodies include a first throttle body having a first intake passage and a second throttle body having a second intake passage and having an accommodation portion for accommodating the actuator, and the throttle device has the position sensor between the first intake passage and the second intake passage. In this case, it is possible to reduce the functional portions around the intake passage as much as possible, so that the thick portion of the throttle body can be reduced, thereby making it possible to suppress the enlargement of the throttle body.

In the throttle device according to the present invention, it is preferable that the throttle valve includes a first throttle valve provided in the first intake passage and a second throttle valve provided in the second intake passage, and the first throttle valve and the second throttle valve are fixed to the identical throttle shaft. In this case, since only one position sensor for detecting the angular displacement of the second transmission member is sufficient, the throttle device as a whole can be miniaturized, so that the degree of freedom on the layout of the vehicle increases.

In the throttle device according to the present invention, the position sensor may be constituted by a movable side detecting element supported by the second transmission member and a fixed side detecting element arranged on an accommodation cover in which the rotation transmission mechanism is accommodated. In addition, the movable side detection element may be disposed on a surface of the second transmission member extending in a radial direction of the throttle shaft. By this configuration, since the movable side detection element can be disposed on the opposing surface of the second transmission member, mounting is easier and the installation space is smaller, so that the degree of freedom of installation in the rotational radius direction also increases. Further, the fixed side detection element for detecting the rotation of the movable side detection element can be easily fixedly arranged. In a case that the throttle device further comprises a torsion coil spring interposed between the throttle body and the throttle shaft and biasing the throttle valve to a predetermined opening degree position, the position sensor can be disposed radially outwardly of an arrangement region of the torsion coil spring. Further, in the throttle device according to the present invention, the movable side detection element of the position sensor may be constituted by a magnet or a brush disposed on a side surface on one end side in a tooth width direction of the second transmission member, and the fixed side detection element of the position sensor may be constituted by a Hall element or a resistance coating film. By this configuration, the position sensor becomes a simple position sensor that can detect the displacement of the movable side detection element with a small number of parts.

Effect of the Invention

According to the present invention, it is unnecessary to dispose the position sensor so as to protrude outside the entire width range of the throttle body, thereby making it possible to miniaturize the throttle device and expand the degree of freedom of arrangement.

DETAILED DESCRIPTION OF THE INVENTION

Hereinafter, embodiments for carrying out the present invention will be described with reference to the drawings.

One Embodiment

FIGS. 1-4 show a configuration of a throttle device according to an embodiment of the present invention.

First, the configuration will be described.

Figure 1:
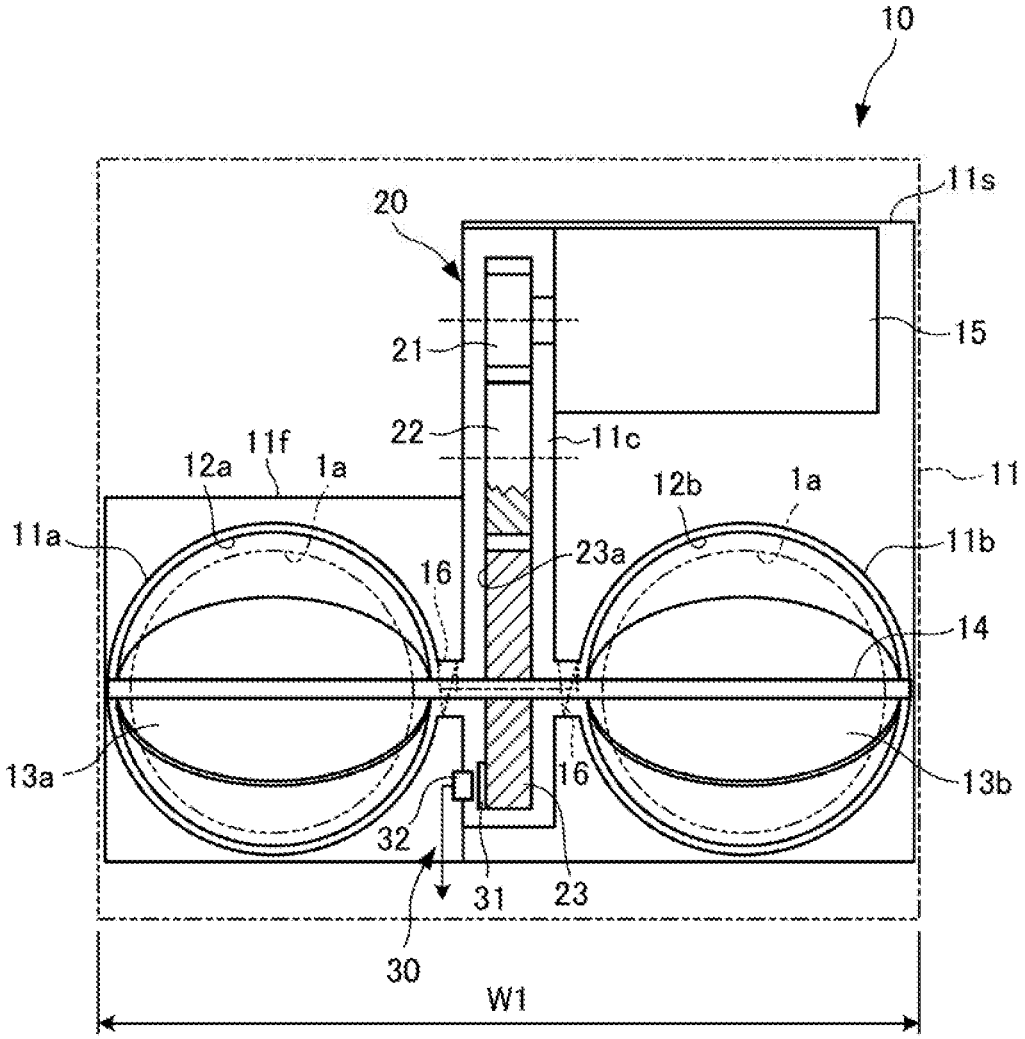
FIG. 1 is a schematic configuration diagram of a main part of a throttle device according to an embodiment of the present invention.
Figure 2:
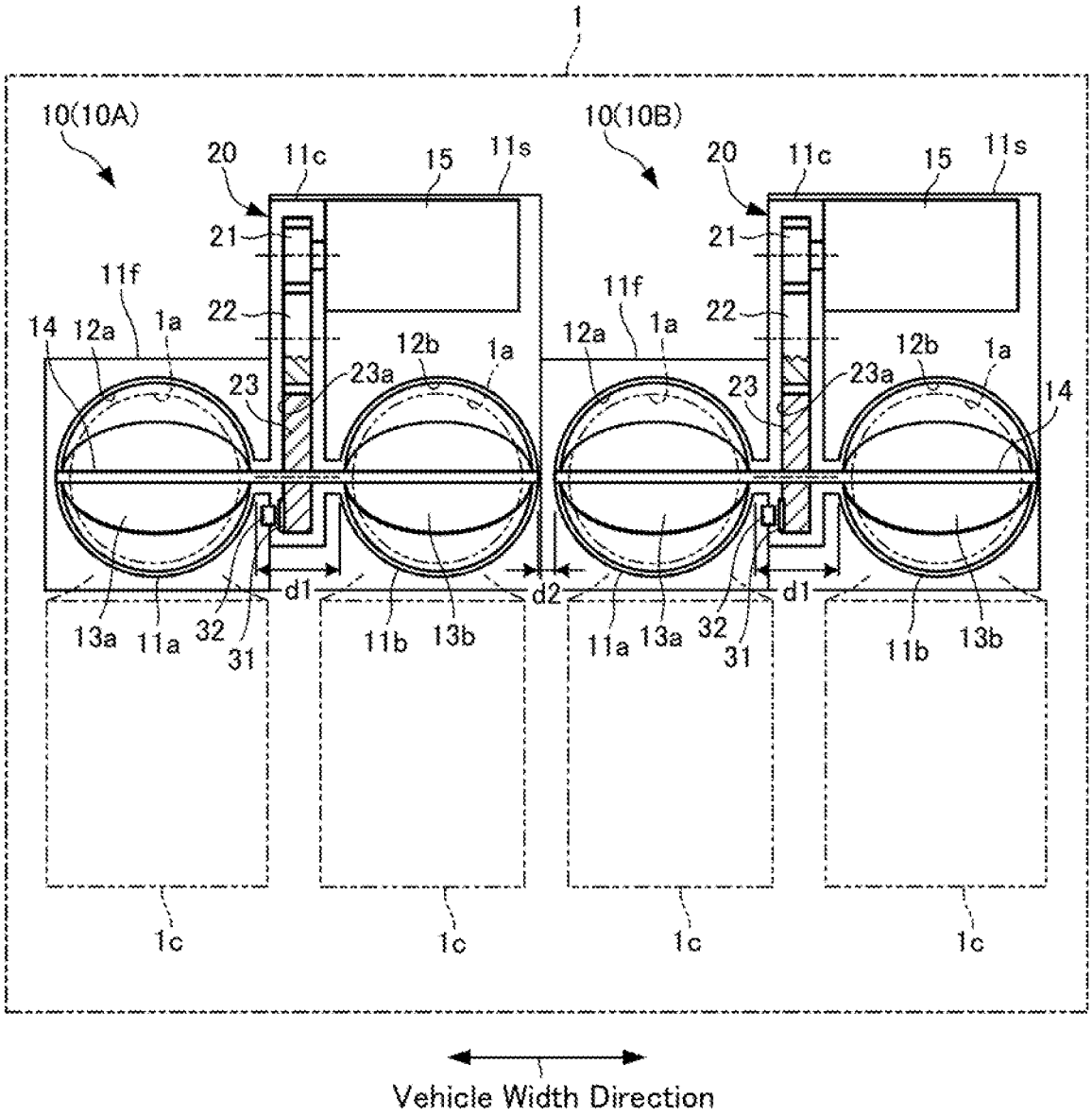
FIG. 2 is a schematic configuration diagram of a throttle device in its entirety in the case where the throttle device according to one embodiment of the present invention is mounted on a four-cylinder engine.
Figure 3:
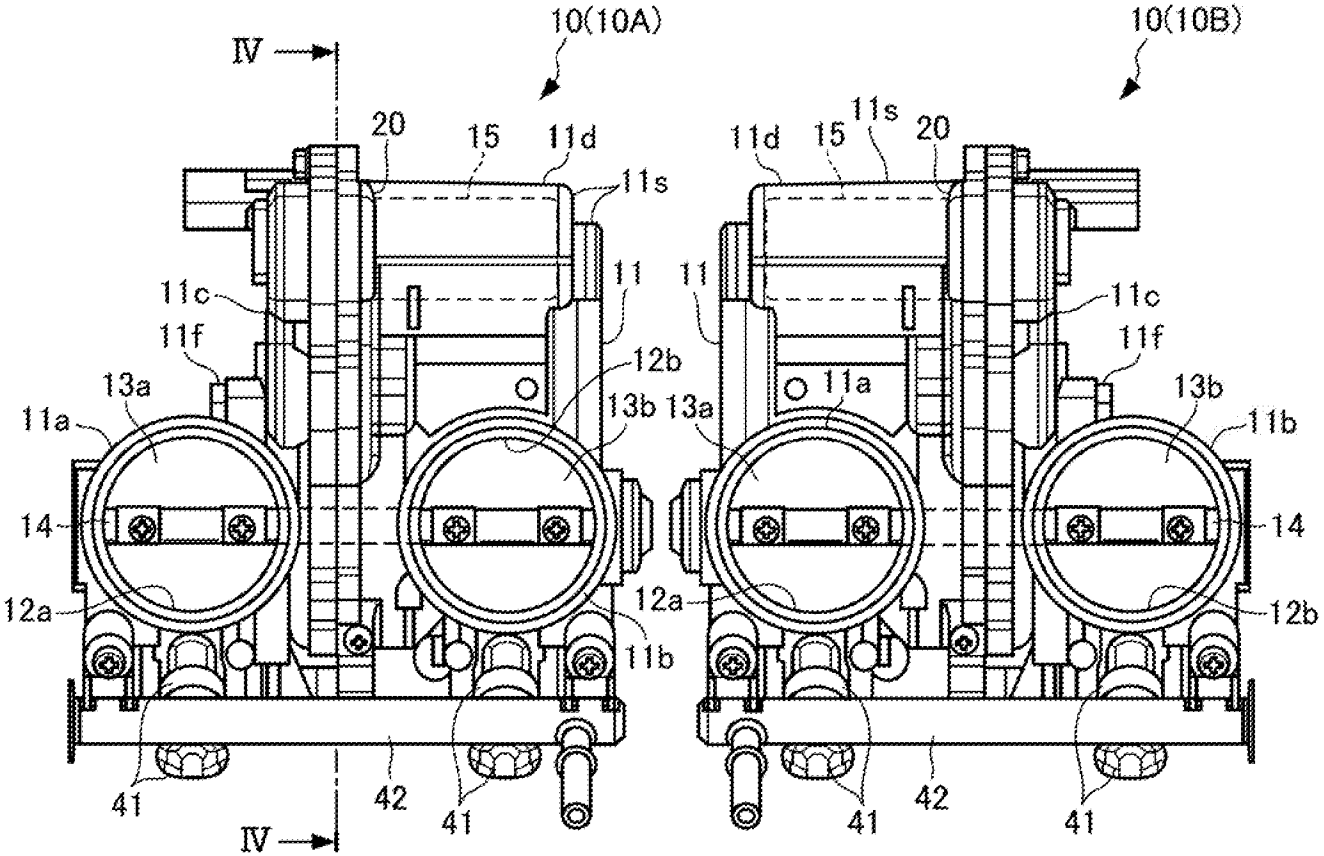
FIG. 3 is a front view of a throttle device in the case where the throttle device according to one embodiment of the present invention is mounted on a four-cylinder engine.

As shown in FIG. 1 and FIG. 2, the throttle device 10 of the present embodiment is a multiple type throttle device adapted to a multi-cylinder internal combustion engine, for example, a four-cylinder engine 1 for a two-wheeled vehicle. Although not described in detail here about the engine 1, a plurality of cylinders 1*c* are adjacent to each other in the left-right direction (vehicle width direction) with respect to the body frame extending in the front-rear direction of the two-wheeled vehicle (the direction perpendicular to the paper surface of FIG. 2). This means that the crankshaft is mounted in a horizontally placed state extending in the vehicle width direction. As shown in FIG. 3, a pair of throttle devices 10 (10A, 10B in FIG. 3) are arranged in parallel to the engine 1 so as to be adjacent to each other on the left and right sides.

As shown in FIG. 1, the throttle device 10 includes a throttle body portion 11*a* (a first throttle body) having an intake passage 12*a* (a first intake passage), a throttle body portion 11*b* (a second throttle body) having an intake passage 12*b* (a second intake passage), a common (same) throttle shaft 14 rotatably supported with respect to the throttle body portions 11*a* and 11*b*, a motor 15 capable of opening and closing the plurality of the throttle valves 13*a* and 13*b* through the throttle shaft 14 and a rotation transmission mechanism 20.

Further, the rotation transmission mechanism 20 is disposed between the throttle body portions 11*a* and 11*b*, so as to be connected to the throttle shaft 14 at a position between the adjacent throttle valves 13*a* and 13*b*, thereby making it possible to transmit power to the substantially central position of the throttle shaft 14.

The throttle body portions 11*a*, 11*b* respectively have an inner circumferential wall surface of a circular cross section and are arranged to be parallel to each other, and form a plurality of intake passages 12*a*, 12*b* (a plurality of branch passages in the case of a manifold) communicating with the plurality of intake ports 1*a*. Further, a plurality of throttle valves 13*a*, 13*b* are provided in the respective intake passages 12*a*, 12*b*, so that the opening degree of throttle valves 13*a*, 13*b* can be controlled. In FIG. 1, the shape of the body portion (unit body 11 to be described later) except for the plurality of throttle body portions 11*a* and 11*b* and a periphery of a rotational transmission path between the throttle body portions 11*a* and 11*b* are schematically shown with a quadrangle. In addition, the plurality of throttle valves 13*a* and 13*b* are respectively of a type in which they are rotated in the valve opening and closing directions, for example a butterfly type, but may be of other types.

The throttle shaft 14 functions as a rotation center axis for rotatably supporting the plurality of throttle valves 13*a*, 13*b* in a fixed length region on both end sides thereof, and rotates in accordance with the rotational (angle) operation amount from the motor 15 through the rotation transmission mechanism 20 at a shaft center portion of the throttle shaft 14, thereby making it possible to control an opening degree of the throttle valves 13*a* and 13*b*.

The motor 15 is an actuator, which is for example a pulse motor such as a step motor or the like, and is adapted to control the rotational angle position of the throttle shaft 14 corresponding to the opening position (throttle position) required for the throttle valves 13*a*, 13*b*, based on the acceleration request input according to the accelerator operation of the two-wheeled vehicle.

The rotation transmission mechanism 20 includes a pinion 21 integrally mounted on the rotation output shaft of the motor 15, an idler gear 22 supported on the unit body 11 so as to be rotatable around the axis while being engaged with the pinion 21, and a control gear 23 integrally connected to the throttle shaft 14 while being engaged with the idler gear 22.

This means that the rotation transmission mechanism 20 is provided, between a pair of intake passages 12*a*, 12*b* adjacent to each other in the left-right direction of the vehicle, with a pinion 21, which is a gear constituting a first transmission member driven by the motor 15, and a control gear 23 which is a gear interlocked with the pinion gear and constituting a second transmission member integrally connected to the throttle shaft 14 in the rotation direction, and further is further provided with an idler gear 22 interposed between the two gears.

In the rotation transmission mechanism 20, the pitch circle radius increases in the order of the pinion 21, the idler gear 22, and the control gear 23, which are interposed between the motor 15 and the throttle shaft 14, thereby making it possible to fulfill the deceleration function and the high precision positioning function.

The throttle device 10 further includes a movable side detection element 31 supported by the control gear 23 and a fixed side detection element 32 capable of detecting the angular displacement (displacement) of the movable side detection element 31. The movable side detection element 31 and the fixed side detection element 32 constitute a position sensor 30 (throttle position sensor) adapted to detect the angular displacement of the throttle shaft 14 and the control gear 23, which is the displacement of the specific portion in the rotation transmission mechanism 20 corresponding to the opening degree of the throttle valves 13*a*, 13*b*, and to output a position signal Pth.

The movable side detection element 31 of the position sensor 30 is constituted by a magnet (which may be a magnetic pattern in which magnetic poles of N/S are alternately arranged) or a brush disposed on a side surface on one end side in the tooth width direction of the control gear 23, while the fixed side detection element 32 of the position sensor 30 is constituted by a Hall element or a resistance coating film.

In FIG. 2, the throttle device 10 is exemplified in a layout adapted to the four-cylinder engine 1. In the figure, two throttle devices 10, each covering a plurality of intake ports 1*a* aligned in the cylinder arrangement direction of the engine 1 for each two cylinders, each having a full width W1, respectively have a unit body 11 constituted by integrating the throttle body portions 11*a*, 11*b*. In each unit body 11, the throttle body portions 11*a*, 11*b* are provided adjacently so that intake passages 12*a*, 12*b* communicating with the plurality of intake ports 1*a* are arranged in parallel, while in the intake passages 12*a*, 12*b*, a plurality of throttle valves 13*a* and 13*b* are provided so as to control the opening degree.

Figure 4:
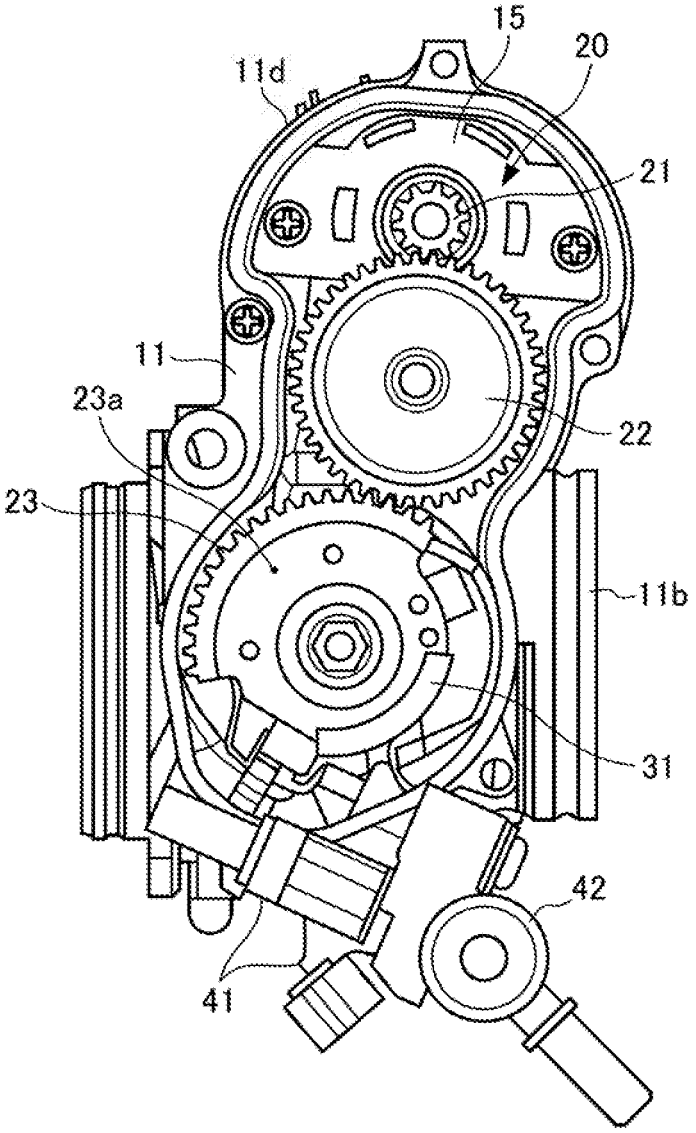
FIG. 4 is a sectional view taken along the line IV-IV of FIG. 3.

FIGS. 3 and 4 show an embodiment in which the throttle device 10 is applied to a four-cylinder engine 1 for a two-wheeled vehicle. The unit body 11 is provided with a plurality of fuel injection valves 41 capable of injecting fuel into the plurality of intake passages 12*a* and 12*b* and a fuel pipe 42 for distributing and supplying fuel to the plurality of fuel injection valves 41. Further, the unit body 11 is constituted by a first segment body 11*f* (first throttle body) and a second segment body 11*s* (second throttle body) integrally fastened in a direction in which the throttle body portions 11*a*, 11*b* are adjacent to each other (left and right direction in FIG. 3), the first throttle body (first throttle body) constituted by integrally connecting a gear cover portion 11*c* covering the rotation transmission mechanism 20 on one side with one of the throttle body portions 11*a* or 11*b*, and a second segment body 11*s* (second throttle body) constituted by integrating a motor cover portion 11*d* (accommodating portion) for accommodating the motor 15 with one of the other throttle body portions 11*b* or 11*a* are disposed adjacent to the throttle body portions 11*a* and 11*b*. Further, the fuel injection valve 41 is provided in each of the first segment body 11*f* and the second segment body 11*s*, and the fuel pipe 42 is so provided to connect the first segment body 11*f* and the second segment body 11*s*.

As shown in FIGS. 1, 3 and 4, the movable side detection element 31 is disposed on an opposing surface 23*a* (one side surface, the surface in a radial direction of the shaft) of the control gear 23 opposed to the gear cover portion 11*c*. The fixed side detection element 32 is mounted on the gear cover portion 11*c*. By his configuration, there is no need to provide a separate case for the position sensor. When an urging unit such as a torsion coil spring 16 for biasing the control gear 23 to a predetermined rotational angle position or a bearing and the like is provided, it is preferable to dispose the movable side detection element 31 and the fixed side detection element 32 in a radially outward side of a region where the torsion coil spring 16 or the like is provided. The urging unit such as the torsion coil spring 16 mentioned here is interposed between, for example, the unit body 11 and the throttle shaft 14 or the control gear 23, so as to urge the throttle valves 13*a*, 13*b* at a predetermined opening position (typically a valve close position) around the throttle shaft 14, wherein the radially outward side refers to a position at an arbitrary radial position outside the radial region necessary for installing the urging unit such as the torsion coil spring 16.

Next, the operation will be described.

In the throttle device 10 of the present embodiment, when the pinion 21 is driven by the motor 15 in response to the acceleration request input according to the accelerator operation of the two-wheeled vehicle, the throttle shaft 14 rotates integrally with the control gear 23 that is engaged therewith, so that the degree of opening of the throttle valves 13*a* and 13*b* changes. This means that the control of the rotational angle position of the throttle shaft 14 corresponding to the opening degree position required for the throttle valves 13*a*, 13*b* is executed.

During the control of the rotational angular position, the angular displacement of the movable side detection element 31 supported on the opposing surface 23*a* (side surface) of the control gear 23 is detected by the fixed side detection element 32 disposed on the side of the gear cover 11*c*, as the rotational angular position of the control gear 23 directly connected to the throttle shaft 14, so that the opening degree of the throttle valve 13*a*, 13*b* is detected.

In the present embodiment, it is not necessary to provide a separate rotation transmission element such as a sensor shaft (a functional portion around the intake passage) in order to transmit the angular displacement of the throttle shaft 14 to the position sensor 30. Accordingly, interval d1 (See FIG. 2) between the two intake passages 12*a*, 12*b* which are disposed adjacent to each other in a cylinder arrangement direction of the engine 1 sandwiching the rotation transmission mechanism 20 and a width dimension of a thick portion (a portion surrounding the rotation transmission mechanism 20) of the unit body 11 corresponding to the d1 can be kept small.

Further, in the present embodiment, two unit bodies 11 are combined to adapt to the four-cylinder engine 1, so that an interval d2 between the two central throttle body portions 11*a*, 11*b* can be narrowed. Furthermore, by combining the two unit bodies 11 to the four-cylinder engine 1, the degree of freedom of installation also increases.

Further, the movable side detection element 31 of the position sensor 30 is disposed on the opposing surface 23*a* of the control gear 23 opposed to the gear cover portion 11*c* of the unit body 11, and a fixed position of the fixed side detection element 32 to detect the rotation of the movable side detection element 31 is in the vicinity of a facing surface of the gear cover portion 11*c* of the first segment body 11*f* (throttle body) in the rotational radius region of the opposing surface 23*a* of the control gear 23. Therefore, the implementation form of the position sensor 30 in the throttle device 10 is extremely compact and the implementation work is easy. Thus, the arrangement of the position sensor can be easy, and the space for the arrangement can be reduced, and the interval d1 between the intake passages 12*a*, 12*b* can be narrowed.

Furthermore, in the present embodiment, since the movable side detection element 31 and the fixed side detection element 32 of the position sensor 30 are respectively disposed at predetermined rotational radial positions of the control gear 23, even though other member, for example the torsion coil spring 16 that urges the control gear 23 to a predetermined angular position or the like, is disposed inside the radical is disposed, the position sensor can be disposed outside the radial direction, and sufficient detection accuracy can be obtained.

In addition, in the present embodiment, the movable side detection element 31 is constituted by the magnet or the brush disposed on the opposing surface 23*a* which is the side surface on the one end side in the tooth width direction of the control gear 23, while the fixed side detection element 32 is constituted by the Hall element or the resistance coating film, so that the position sensor 30 is compact and simple in the configuration, thereby making it possible to provide a compact throttle device 10 with a reduced full width W1.

Thus, according to the present embodiment, the position sensor 30 does not need to protrude out of the range of the entire width of the throttle body as in the conventional art, so that the throttle device 10 can be made compact and the degree of freedom of arrangement can be increased. Therefore, the mountability of the engine 1, having the throttle device 10 provided therein, on a body frame of a two-wheeled vehicle can be improved.

Figure 5A:
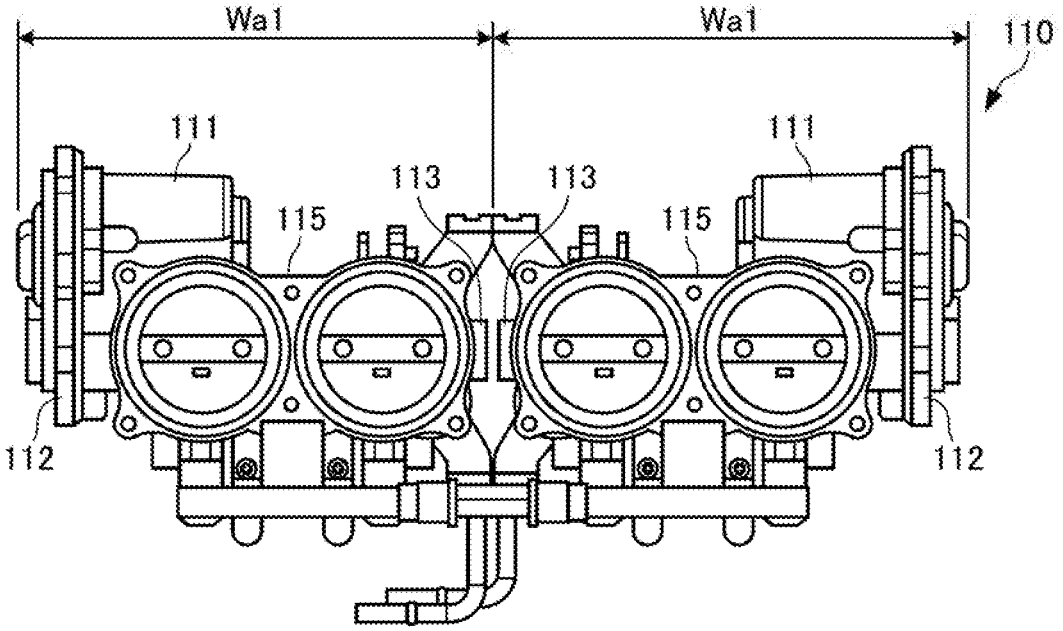
FIGS. 5A and 5B show front views of two examples where two of the throttle devices mounted on the four-cylinder engine are conventionally configured.
Figure 5B:
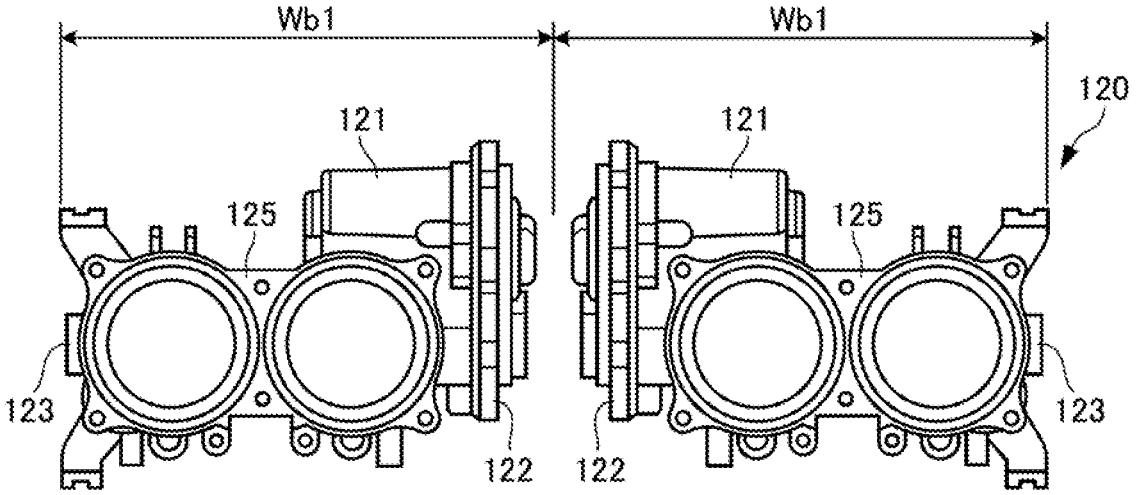

FIGS. 5A and 5B show conventional throttle devices 110, 120 applied to the four cylinders of the engine. In the figures, the gear transmission mechanisms 112, 122 and the position sensors 113, 123, which perform rotational transmissions from the motors 111, 121 to the throttle shaft (without a reference numeral), are disposed at both ends of the respective throttle shafts. In this case, the angular displacement of the throttle shaft can be directly detected by the position sensors 113, 123, and it is possible to exclude errors due to backlashes in a transmission path as in the case of providing a sensor on the side of the motors 111, 121. However, in this case, due to the existence of both throttle position sensors 113, 123 and the gear transmission mechanism 112, 122, the entire widths Wa1, Wb1 of the throttle devices 110, 120 become larger with respect to the entire width of the throttle body 115, 125, respectively by the widths of the gear transmission mechanism 112, 122 or the throttle position sensors 113, 123.

In the throttle device of the present invention, by disposing a gear transmission mechanism and a position sensor, conventionally disposed on the end side of the throttle shaft, between the two throttle bodies, the entire width of the throttle device can be narrowed compared to the conventional throttle device, thereby contributing to the improvement of mountability of the throttle device to the engine. Further, by disposing the position sensor at the center of the throttle shaft, it is possible to ensure favorable detection accuracy without being affected by an accuracy error or the like due to twisting of the throttle shaft. Still further, by providing the gear transmission mechanism in a case that accommodates the throttle bodies, it is possible to narrow the full width W1, thereby improving the fitness of the throttle device to a two-wheeled vehicle.

Figure 6:
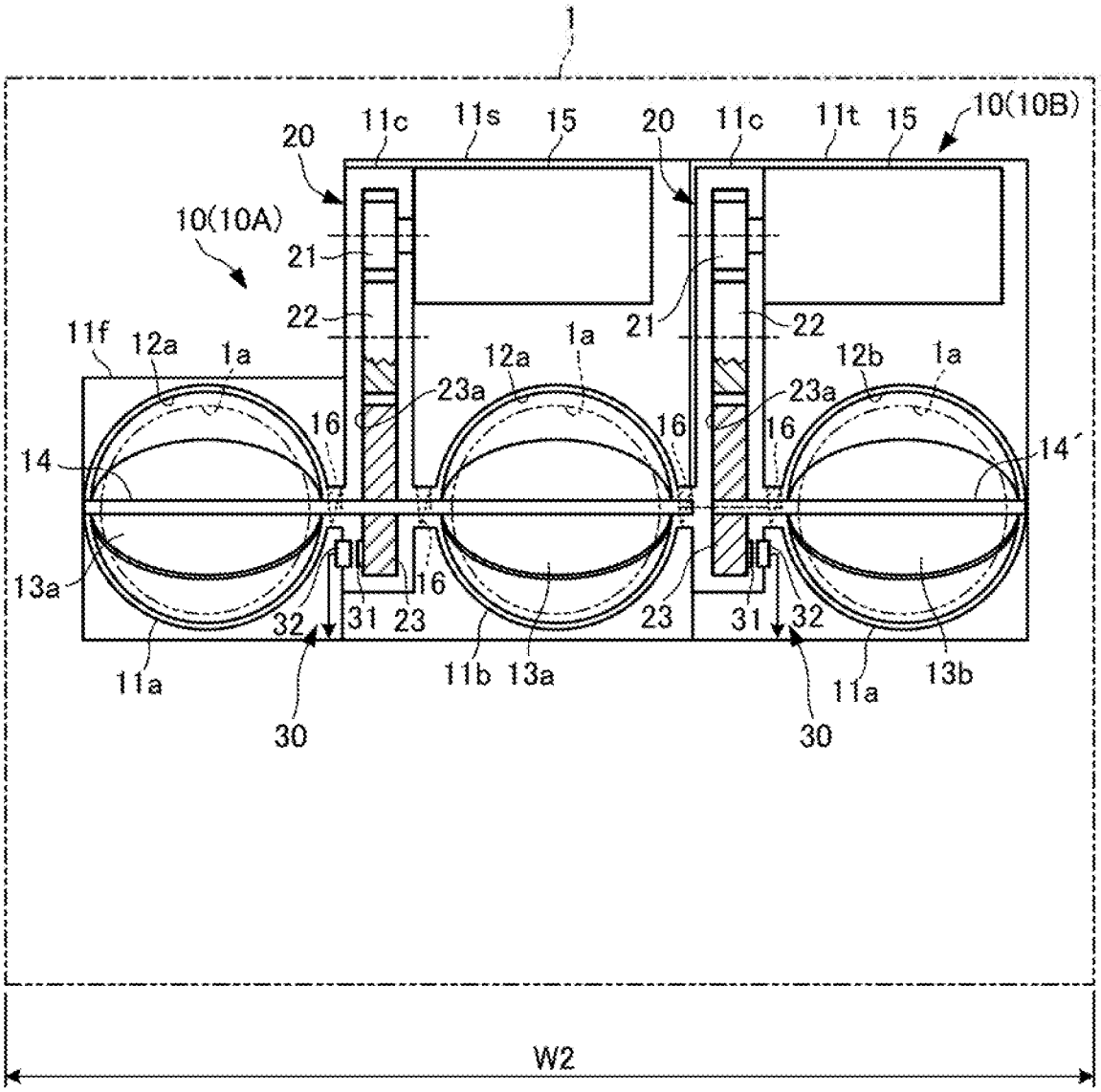
FIG. 6 is a schematic configuration diagram of a throttle device in its entirety in the case where the throttle device according to one embodiment of the present invention is mounted on a three-cylinder engine.

In the above-described embodiment, the throttle device is mounted on a four-cylinder engine, but the present invention is also applicable to a throttle device mounted on an engine of two or more cylinders. For example, in the case that the throttle device is mounted on a three-cylinder engine 1 as shown in FIG. 6, a throttle device 10A for two cylinders similar to the main portion of one embodiment as shown in FIG. 1 and a throttle device 10B having a third segment body 11*t* for one cylinder which is constituted by removing the throttle valve 13 on one side of the throttle device 10A and leaving a portion 14' of the throttle shaft 14, can be mounted in combination. In this case as well, it is possible to suppress the whole width W2 of the engine 1, so that the arrangement of the throttle device in the body frame of the two-wheeled vehicle is easy, thereby improving the mountability.

Although the rotation transmission mechanism 20 is exemplified by employing three gears, the number of gears may be arbitrary, and the rotation transmission elements may be other than gears. When a plurality of throttle devices 10 respectively for two cylinders are arranged in the cylinder arrangement direction, instead of disposing the motor 15 on one side in the left-right direction of the vehicle with respect to the rotation transmission mechanism 20 as shown in FIG. 2, the motor 15 may be arranged to be inverted on both sides in the left-right direction of the vehicle body, considering the center of gravity in relationship with other equipment.

Further, in the present embodiment, the movable side detection element 31 and the fixed side detection element 32 of the position sensor 30 for detecting the throttle opening are opposed to each other in the tooth width direction of the control gear 23, but since a meshing teeth portion of the control gear 23 is formed only in a range sufficient for rotation position control of the throttle valve 13 and is not formed around the entire circumference, the movable side detection element 31 and the fixed side detection element 32 may be so arranged to oppose each other in the radial direction of the control gear 23 within a range of a predetermined angle on the missing tooth side.

As described above, according to the present invention, it is not necessary to dispose the position sensor so as to protrude outside the entire width range of the throttle body, so that it is possible to achieve the effect that the throttle device can be miniaturized and the degree of freedom of arrangement of the throttle device can be increased, and thus the present invention is useful for a multilateral throttle device in general in which a plurality of throttle valves on the intake passage of an engine are controlled by an actuator in common.

EXPLANATION OF REFERENCE NUMERALS

1 engine
1*a* intake port
10 throttle device
11 unit body (throttle body)
11*a* throttle body portion (first throttle body)
11*b* throttle body portion (second throttle body)
11*c* gear cover portion
11*d* motor cover portion (accommodation portion)
11*f* first segment body (first throttle body)
11*s* second segment body (second throttle body)
12*a*, 12*b* intake passage
13*a*, 13*b* throttle valve
14 throttle shaft
15 motor (actuator)
16 torsion coil spring (urging unit)
20 rotation transmission mechanism
21 pinion (first transmission member, gear)
22 idler gear (gear)
23 control gear (second transmission member, gear)
23*a* opposing surface (one side surface, surface in the radial direction of the shaft)
30 position sensor (throttle position sensor)
31 movable side detection element (magnet or brush)
32 fixed side detection element (Hall element or resistance coating film)
41 fuel injection valve
42 fuel pipe
D1 interval
W1 full width

The invention claimed is:

1. A throttle device mounted on an engine having a plurality of intake ports, the throttle device comprising: a first throttle body having a first intake passage and a second throttle body having a second intake passage; a first throttle valve provided in the first intake passage and a second throttle valve provided in the second intake passage; a throttle shaft supporting the first throttle valve and the second throttle valve; an actuator that drives the first throttle valve and the second throttle valve to open and close through the throttle shaft; a rotation transmission mechanism interposed between the actuator and the throttle shaft; and a position sensor that detects a displacement in the rotation transmission mechanism, wherein the rotation transmission mechanism includes a first transmission member driven by the actuator and a second transmission member capable of interlocking with the first transmission member and is-the second transmission member is integrally connected to the throttle shaft in a rotation direction, the position sensor, that detects the displacement of the second transmission member, and the rotation transmission mechanism are disposed between the first throttle body and the second throttle body, the position sensor includes a movable side detection element supported by the second transmission member and a fixed side detection element arranged on an accommodation cover in which the rotation transmission mechanism is accommodated, and the fixed side detection element is configured to detect an angle displacement of the movable side detection element, the movable side detection element is disposed on a surface of the second transmission member, the surface extending in a radial direction of the throttle shaft and opposed to an accommodation cover covering the rotation transmission mechanism on one side, the second throttle body having an accommodation portion for accommodating the actuator, the first throttle body and the second throttle body integrally fastened in a direction in which the first throttle body and the second throttle body are adjacent to each other, the first throttle body, constituted by integrally connecting the accommodation cover covering the rotation transmission mechanism on one side with one of the throttle bodies, and the second throttle body, constituted by integrating the accommodation portion with the other one of the throttle bodies, and the throttle device has the position sensor between the first intake passage and the second intake passage.

2. The throttle device according to claim 1, further comprising a torsion coil spring interposed between one of the throttle bodies and the throttle shaft and biasing a throttle valve of the plurality of throttle valves to a predetermined opening degree position, wherein the position sensor is disposed radially outwardly of an arrangement region of the torsion coil spring.

3. The throttle device according to claim 1, wherein the movable side detection element of the position sensor is constituted by a magnet or a brush disposed on a side surface on one end side in a tooth width direction of the second transmission member, and the fixed side detection element of the position sensor is constituted by a Hall element or a resistance coating film.

4. The throttle device according to claim 1, wherein the movable side detection element and the fixed side detection element are opposed to each other in a radial direction of the second transmission member, and the movable side detection element is opposed to a meshing teeth portion of the second transmission member in a radial direction of the second transmission member.

* * * * *